US007043765B1

(12) United States Patent
Otsubo

(10) Patent No.: US 7,043,765 B1
(45) Date of Patent: May 16, 2006

(54) SHIRT WITH COOLING COLLAR AND COOLING POCKETS

(76) Inventor: Hirofusa Otsubo, 60 - 16 83rd Pl., Elmhurst, NY (US) 11379

( * ) Notice: Subject to any disclaimer, the term of this patent is extended or adjusted under 35 U.S.C. 154(b) by 91 days.

(21) Appl. No.: 10/787,927

(22) Filed: Feb. 27, 2004

Related U.S. Application Data

(63) Continuation-in-part of application No. 10/233,737, filed on Sep. 3, 2002, now abandoned.

(60) Provisional application No. 60/397,296, filed on Jul. 22, 2002.

(51) Int. Cl.
*A41D 13/00* (2006.01)

(52) U.S. Cl. ..... 2/69; 2/115; 2/129

(58) Field of Classification Search ..... 2/69, 2/77, 98, 105, 106, 108, 113–116, 127, 129, 2/DIG. 1; 607/108, 109, 112, 114
See application file for complete search history.

(56) References Cited

U.S. PATENT DOCUMENTS

| | | | | | |
|---|---|---|---|---|---|
| 1,473,506 | A | * | 11/1923 | Nessler | 607/109 |
| 1,567,931 | A | * | 12/1925 | Epler | 607/112 |
| 5,038,779 | A | * | 8/1991 | Barry et al. | 607/108 |
| 5,088,549 | A | * | 2/1992 | Schneider | 165/46 |
| 5,247,928 | A | * | 9/1993 | Stilts, Jr. | 607/109 |
| 5,375,261 | A | * | 12/1994 | Lipke | 2/92 |
| 5,605,144 | A | * | 2/1997 | Simmons et al. | 126/204 |
| 5,861,022 | A | * | 1/1999 | Hipskind | 607/109 |

* cited by examiner

*Primary Examiner*—Gloria M. Hale
(74) *Attorney, Agent, or Firm*—Robert J. Bird

(57) ABSTRACT

A shirt includes a collar with inner and outer layers forming ice pockets spaced around the collar. The pockets are for ice to cool the main blood vessels and spinal nerves in the neck of the wearer. In use, the collar is either in an upstanding closed position around the wearer's neck in a turtleneck fashion, or in a spread-open position if the closed collar is too warm or too cold. The shirt also includes ice pockets behind armpit locations where arteries are close to the skin. The shirt enhances the transfer of heat from the wearer to melt ice in the ice pockets, to warm the meltwater, and to evaporate the water.

1 Claim, 1 Drawing Sheet

SHIRT WITH COOLING COLLAR AND COOLING POCKETS

CROSS-REFERENCE TO RELATED APPLICATIONS

This is a continuation-in-part of application Ser. No. 10/233,737 filed on Sep. 3, 2002 now abandoned, which in turn is founded on provisional applicaton No. 60/397,296 filed on Jul. 22, 2002.

BACKGROUND OF THE INVENTION

This invention relates to an article of apparel with provision for cooling the wearer's neck, head, and body.

In human anatomy, two main blood vessels under the chin and on the sides of the "adam's apple" carry blood to and from the brain. Skin or surface temperature at these locations affects the temperature of blood going to the brain. Physical exertion also affects blood temperature. Human body temperature is self regulating, but only within limits. Extreme conditions of temperature, humidity, or physical exertion, call for extra measures to help maintain proper temperature of blood to the brain.

Blood to the brain which is at a temperature above a "normal" temperature range makes a person slow, lethargic, and drowsy. Drivers are in danger of going to sleep while driving. In extreme heat, we all are subject to loss of efficiency and heat exhaustion. Sports participants, for example golfers, lose attention and focus, and produce errant shots and putts.

It is an object of this invention is to provide a shirt with provision for cooling the wearer in circumstances such as those just mentioned.

Another object is to provide a shirt for keeping the wearer both cool and awake in such circumstances.

Prior art that I know of includes the following:

U.S. Pat. No. 5,295,949 (Hathaway) shows a neckband, separate from shirt or other garment, with ice pouches in it.

U.S. Pat. Appl. Publ. No. US2002/0035745A1 (Spell) shows an ice pouch suspended from the back of a hat to cool the neck.

U.S. Pat. No. 5,247,928 (Stilts) discloses a shirt collar attachment with an interior compartment lined with a plastic container to prevent leakage. The purpose of Stilts is to position a liquid-impervious plastic container (hot or cold) around the wearer's neck.

U.S. Pat. No. 5,088,549 (Schneider) discloses a neckband with pouches in it by which to slectively position liquid-impervious heat exchange elements at desired locations around the wearer's neck.

U.S. Pat. No. 5,375,261 (Lipke) discloses a dickie with an upstanding collar which includes a pocket to hold a "warmer pack" (a warmer pack being either a solid material, or a liquid-impervious container of liquid).

U.S. Pat. No. 5,038,779 (Barry) discloses a garment with pockets at various locations to position "thermal control packets". The thermal control packets are liquid-impervious; i.e. of the well known type that are reusable and can be heated, cooled, frozen, etc.

The above prior art all has one characteristic in common: the heat exchange media (ice/water, or chemical) are all in liquid-impervious containers, and such containers are not an integral part (i.e. collar or pocket) of a shirt for normal everyday use.

SUMMARY OF THE INVENTION

In summary, this invention is a shirt having a collar with inner and outer layers forming ice pockets spaced around the collar. The pockets are for ice to cool the main blood vessels and spinal nerves in the neck of the wearer. In use, the collar is either in an upstanding closed position around the wearer's neck in a turtleneck fashion, or in a spread-open position if the closed collar is too warm or too cold. The shirt also includes ice pockets behind armpit locations where arteries are close to the skin. The shirt enhances the transfer of heat from the wearer to melt ice in the ice pockets, to warm the meltwater, and to evaporate the water.

DETAILED DESCRIPTION

Figure 1:
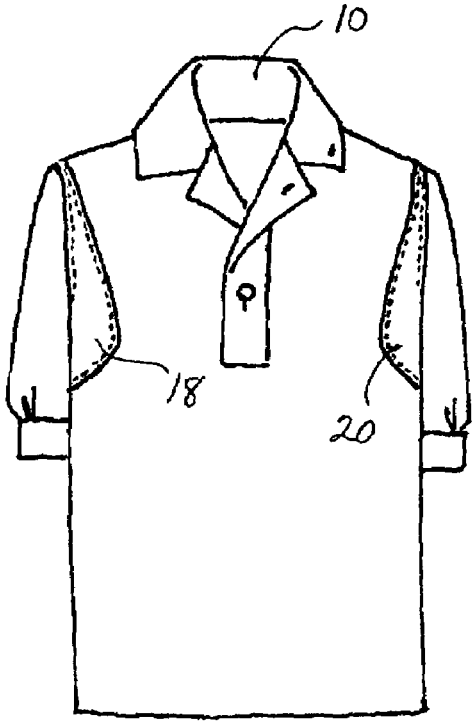
FIGS. 1 and 2 are illustrative of a shirt with a double collar and side ice pockets according to this invention.
Figure 2:
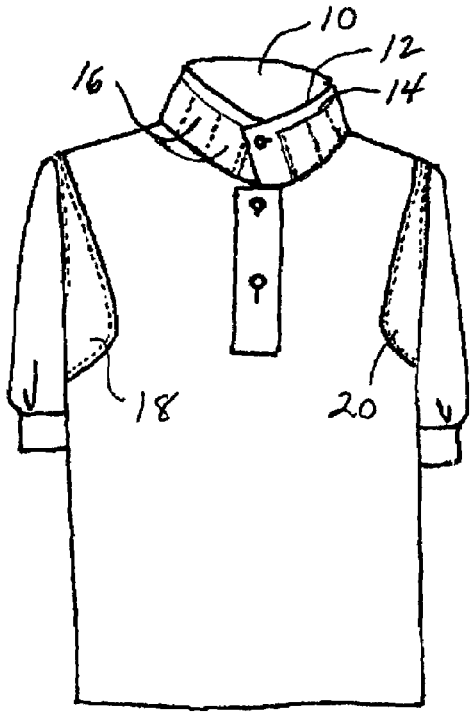

Referring now to the drawing, FIGS. 1, 2 show a shirt with a collar 10. The collar 10 includes inner and outer layers 12, 14 forming a number of separate open-top ice pouches 16 between them. The shirt and collar are made of cloth. For purposes of the appended claim, it is specified here that cloth is a moisture-permeable material.

The shirt also includes an ice pocket 18 on one side, and an ice pocket 20 on the other side. The ice pockets 18, 20 are at armpit locations, and extend from the front of the shirt, as shown, to similar positions (out of sight) on the back of the shirt. Armpits are sensitive to cold because main arteries there are close to the skin. Ice in these pockets is an effective cooler for someone working in extreme heat, and a wakener for someone subject to drowsiness from heat.

FIG. 1 shows the collar 10 unbuttoned and open. This is its "normal" condition for ordinary dry use, or for use after ice has been inserted and melted or dumped from the pockets 16. If there has been ice in the pockets 16 and the collar feels too cold, the open collar enables the wearer to space the pockets from the neck to alleviate the cold.

FIG. 2 shows the collar 10 closed, in an upright mock-turtleneck configuration. This position is appropriate for hot weather (with ice in the pockets 16), for cold weather (without ice), or in strong sun (with or without ice) to protect neck skin.

Coldness can be regulated by varying the number and location of ice pockets 16 used, or by the open/closed condition of the collar, or by both methods.

There are three heat transfer processes occurring in the system of this invention:

1) Melting; Ice enclosed in a moisture-permeable material absorbs heat from adjacent skin of the wearer. Melting ice makes the material wet.

2) Heating; Heat continues to transfer from the wearer to the wet material until the material reaches body temperature.

3) Evaporation; Water evaporates from the material. Evaporation is a cooling process in which the evaporating medium (water) absorbs heat from a heat source (skin).

All of these processes are cooling processes; they absorb heat from the object being cooled. Evaporation is by far the most effective of these cooling processes because the "heat of vaporization" of water is nearly seven times its "heat of fusion". As an example: An ounce of ice at 32° F. absorbs 9 BTU from a heat source (skin) to become water at 32° F.

That ounce of water then absorbs 4 BTU from the skin to reach 98° F. body temperature. Then, that ounce of water as it evaporates absorbs 61 BTU from the skin.

By comparison, in the collars of the prior art discussed above, the heat transfer medium (ice/water) is melted and warmed, but it is not evaporated. It cannot evaporate because of its liquid-impervious containers. Evaporation, the most effective cooling process, is not available to it. Thus, after its melting and warming, the medium cannot absorb any more heat from the heat source.

The cooling effect of a damp cloth surface is known in other contexts. Soldiers in the field employ a "Lister bag" (which resembles a giant hammock) to keep water cool in hot dry climates. The bag contains water; the skin of the bag is always wet; evaporation from the skin cools the water in the bag.

The shirt collar of this invention has several advantages. It is adaptable to function in cold weather as a warm standup collar; in moderate weather as an open collar; in strong sun as a neck skin cover; and in the hottest weather as a cooling collar. Another advantage is that the collar and side pockets are not removable attachments, but integral permanent parts of the shirt.

The term "ice pocket" means a pocket for insertion of ice. Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A cloth shirt including a cloth collar, said cloth shirt and collar being moisture-permeable, said collar including inner and outer layers forming between them a plurality of open-top ice pouches along the length of said collar;

said collar adapted to be, alternatively, turned up in turtleneck mode around the neck of the wearer of said shirt, and turned down in spread-open configuration;

said collar, when turned up, adapted to contain ice in said ice pockets whereby to absorb heat from the neck of said wearer to melt ice in said ice pockets, to warm meltwater from said ice, and to evaporate said meltwater;

said plurality of ice pockets permitting selective placement of ice among said ice pockets, thereby to modify the cooling effect thereof.

* * * * *